US005400869A

United States Patent [19]

Rocourt

[11] Patent Number: 5,400,869

[45] Date of Patent: Mar. 28, 1995

[54] METHOD AND DEVICE FOR ASCENDING ALONG A ROPE

[75] Inventor: Jean-Louis Rocourt, Saint Nazaire Les Eymes, France

[73] Assignee: Petzl S.A., Crolles, France

[21] Appl. No.: 945,880

[22] Filed: Sep. 17, 1992

[30] Foreign Application Priority Data

Sep. 30, 1991 [FR] France ..... 91 12094

[51] Int. Cl.[6] ..... A63B 27/00

[52] U.S. Cl. ..... 182/133; 182/5

[58] Field of Search ..... 182/133-136, 182/5-7, 191-193, 3; 188/65.1-65.4

[56] References Cited

U.S. PATENT DOCUMENTS 1,650,281 11/1927 Knudson ..... 188/65.1
1,890,992 12/1932 Janssen ..... 188/65.1
1,921,627 8/1933 Lucchesi ..... 188/65.1
3,112,816 12/1963 Halford ..... 188/65.2 X

FOREIGN PATENT DOCUMENTS 1429441 of 1966 France .
2422587 11/1979 France .

*Primary Examiner*—Alvin C. Chin-Shue
*Attorney, Agent, or Firm*—Stevens, Davis, Miller & Mosher

[57] ABSTRACT

A device for ascending along a rope comprises a pair of ascenders and a leg loop in the form of a pedal cooperating with a cord passing over two pulleys to form a tackle device authorizing a gearing down effect of the effort exerted on the leg loop. The effort required for an ascending step corresponds to two thirds of the weight of the climber, whereas the leg travel when moving from the standing position to the sitting position is about one and a half times the distance of an ascending step.

4 Claims, 10 Drawing Sheets

METHOD AND DEVICE FOR ASCENDING ALONG A ROPE

BACKGROUND OF THE INVENTION

The invention relates to a method for ascending along a main rope, making use of a dynamic sit-stand system comprising a first ascender fixed to the roping harness of the climber with passage of the rope, and a second ascender joined by a link cord to a leg loop, said second ascender being engaged on the main rope above the first ascender, and the ascending movement being performed in a succession of elementary steps, each of which is generated in the course of:

a first stage involving a push on the leg loop causing jamming of the second ascender at a predetermined point of the rope, and a sliding movement of the first ascender along the rope in the direction of the second ascender, releasing the push on the leg loop in the standing position of the climber then resulting in automatic jamming of the first ascender due to the action of the climber's weight, and a second stage involving lifting of the second ascender by the climber's hand pulling the leg loop upwards to a sitting position.

There are several methods of ascending along a rope, used in caving for ascending shafts of different heights. Two of these prior art methods are described to serve as examples.

In FIGS. 1 and 2, the FROG or DED process for ascending along a fixed rope 10 makes use of a dynamic sit-stand system operating with a pair of ascenders 12,14 and a leg loop 16 in the form of a pedal. The first ascender 12 is fixed to the roping harness 18 of the climber 20, and cooperates in the ventral zone with the rope 10 to freely authorize an ascending movement of the climber 20 according to the arrow M, and to oppose any opposing descending movement D by a self-jamming action on the rope 10.

The second ascender 14 has a similar operation to the first, and is joined to the leg loop 16 by a link cord 22 having a diameter generally smaller than that of the main rope 10. The second ascender 14 is engaged on the rope 10 above the first ascender 12, and can be moved in the upwards direction M by a lifting action by means of the hand 24 of the climber 20.

The leg loop 16 is designed for placing the foot of the right or left leg or both feet in the same loop, but it is also possible to provide a pair of separate pedals for engagement of both feet of the climber 20.

The ascending movement along the rope 10 is performed in a succession of elementary steps, each of which comprises:

a first stage involving pulling on the arms and simultaneous pushing on the leg loop 16, in the course of which a vertical force F1, directed in the downwards direction D, causes jamming of the second ascender 14 by the reaction of the cord 22. The second ascender 14 remains immobilized at the point A of the main rope 10, and the first ascender 12 is urged slidingly in the upwards direction M, until the distance d is taken up by coming into abutment against the fixed second ascender 14. The leg is then stretched, and the climber is in the standing position in which, after the push on the leg loop 16 has been released, the first ascender 12 is automatically jammed by the weight P of the climber 20.

and a second stage involving lifting of the second ascender 14 by the hand 24 of the climber 20 which causes the leg loop 16 to be pulled up to a sitting position, in which the leg or legs of the climber 20 are bent.

He then merely has to push on his legs again to come back to the standing position, and so on.

In the FROG ascending process, to ascend a step d requires a vertical movement of the same length of the second ascender 14, and of the leg loop 16. In the course of this movement, the thrusting force F1 on the leg loop 16 is appreciably equal to the weight P of the climber 20, ignoring the traction forces of the hand 24.

The FROG ascension consisting in standing (legs stretched), then sitting (legs bent), requires forces proportional to the weight P of the climber 20.

To gear down the thrusting force on the leg loop 16, the "Italian" method, represented in FIGS. 3 and 4, consists in attaching the cord 22 to the first ascender 12, with an intermediate passage over a first pulley 26 secured to the second ascender 14. The link cord 22 forms a half-turn mounted on the pulley 26, and connected respectively by its opposite ends to the first ascender 12 and to the leg loop 16.

The gearing down effect generated by the presence of the pulley 26 enables the effort exerted on the leg loop 16 to be divided by two in comparison with the FROG process. The force modulus F2 (FIG. 4) corresponds appreciably to half of the weight P of the climber 20, naturally ignoring the traction forces of the hand 24. But the shortcoming of this "Italian" method lies in the greater movement of the leg loop 16.

For the climber 20 to ascend one step along the rope 10, the vertical movement of the leg corresponds appreciably to a doubling of the distance of the step. This results in a certain slowness of movement, and this method is not suitable for ascending shafts of large heights, for example more than 15 meters, because of the breathlessness it causes.

A first object of the invention consists in finding an efficient method for ascending along a rope, whereby the problems of gearing down efforts can be conciliated with the movement travel.

SUMMARY OF THE INVENTION

The method according to the invention is characterized in that the climber uses a gearing down effect of the effort exerted on the leg loop, such that the modulus of said force necessary for an ascending step corresponds appreciably to two thirds of the weight of the climber, whereas the corresponding travel of the leg when moving from the standing position to the sitting position is about one and a half times the distance of an ascending step.

The gearing down effect of the effort is generated by a tackle device secured to the leg loop. This results in optimum operation of the sit-stand system, requiring a moderate effort on the leg loop for a leg travel slightly greater than the distance of an ascending step.

A second object of the invention consists in achieving a particularly efficient device for ascending along a rope, comprising:

a first ascender fixed to the roping harness of the climber, a second ascender engaged on the main rope above the first ascender, and able to be moved in the ascending direction by the hand of the climber, and a leg loop in the form of a pedal, cooperating with a cord one end of which is attached to the first ascender after passing over a first pulley secured to the second ascender.

The device is characterized in that the cord also passes over a second pulley secured to the leg loop, and that the other end of the cord is fixed to the second ascender in such a way as to form a tackle device.

The first pulley is associated with the second ascender at a predetermined point located above the attachment point of the cord, notably at the level of the jamming catch.

The attachment of the cord to the first ascender must be as short as possible. It can be achieved by means of a knot, or a securing device. The ascension of the first ascender in the direction of the second ascender then presents a maximum travel. This results in a minimum of tiring in the course of the second lifting stage.

A third object of the invention aims to achieve an ascender for implementation of the method according to the invention.

The ascender with pivoting catch according to the invention is characterized in that a pulley is fixed to the external flank of the body near the jamming zone of the catch to enable a cord to pass, notably of a tackle device associated with a leg loop.

BRIEF DESCRIPTION OF THE DRAWINGS

Other advantages and features will become more clearly apparent from the following description of an illustrative embodiment of the invention, given as a non-restrictive example only and represented in the accompanying drawings, in which.

DESCRIPTION OF THE PREFERRED EMBODIMENT

Figure 1:
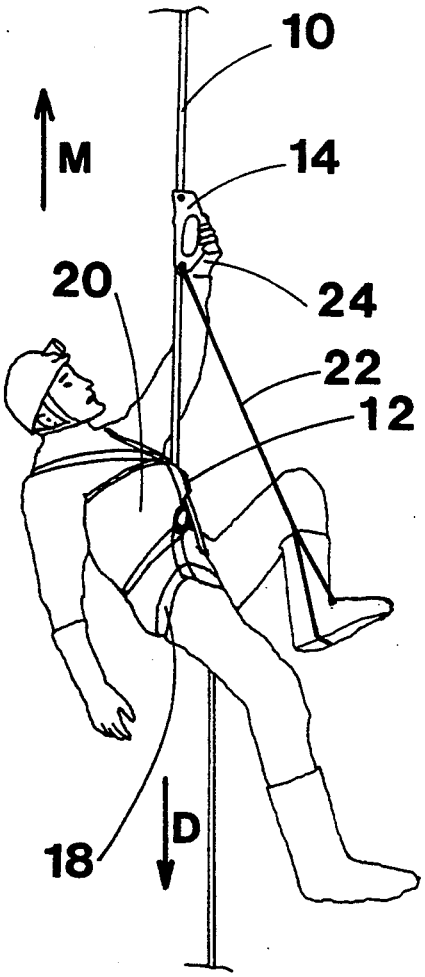
FIGS. 1, and 2 represent the FROG process according to the above-mentioned prior art.
Figure 2:
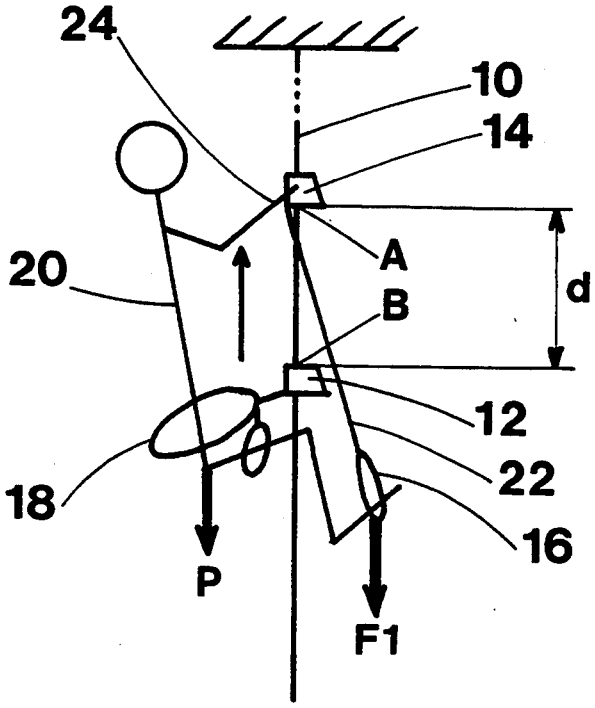
Figure 3:
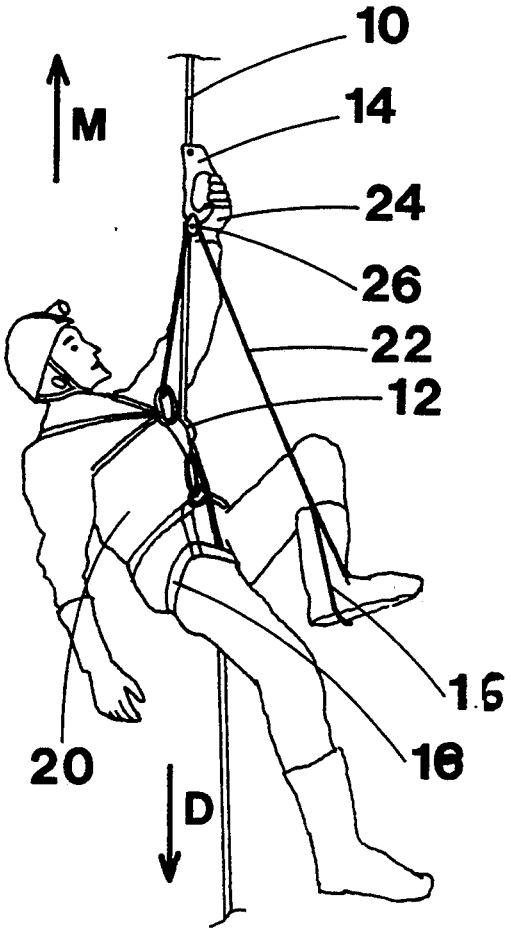
FIGS. 3 and 4 show identical views to FIGS. 1 and 2, of another prior art method called the "Italian" method.
Figure 4:
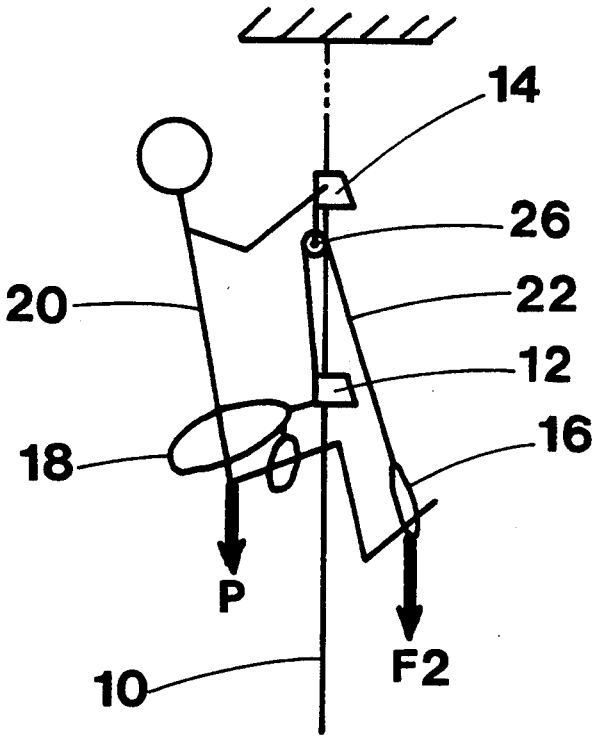
Figure 5:
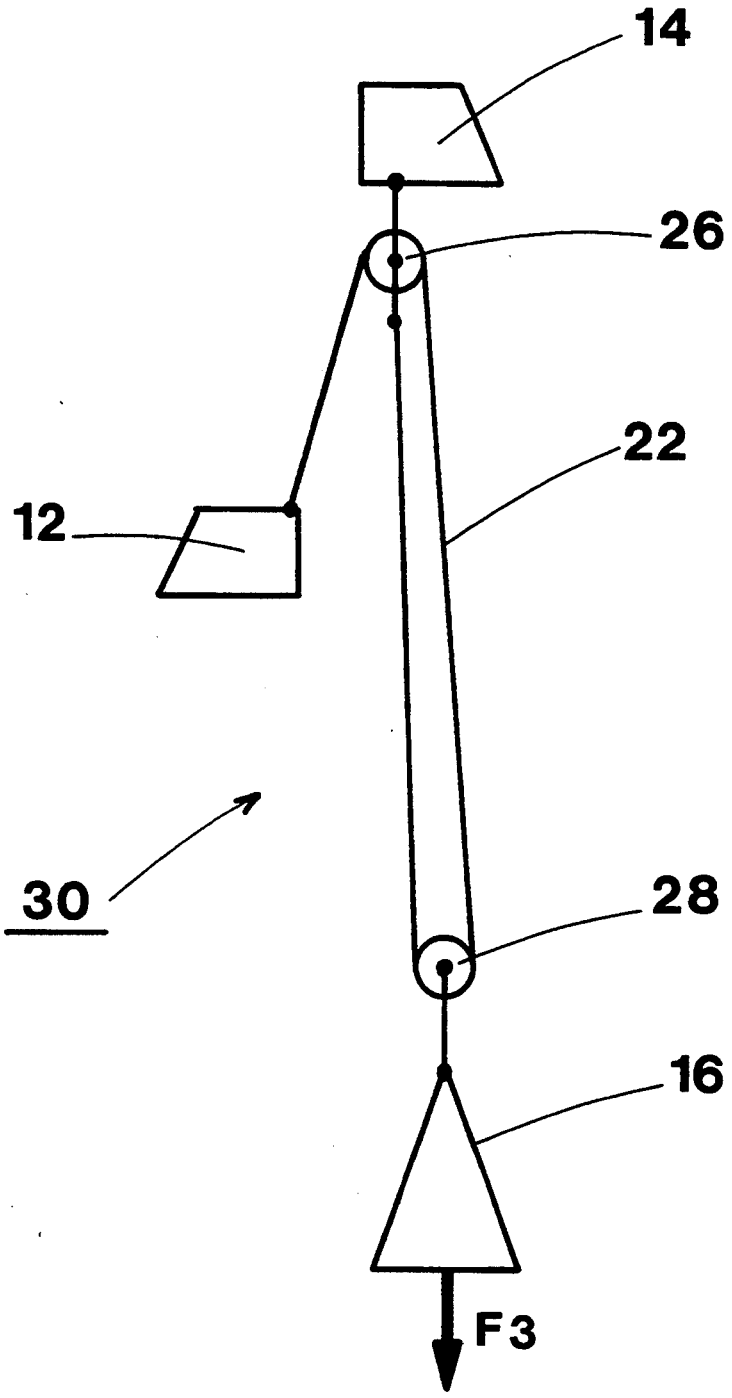
FIG. 5 is a schematic view of the device according to the invention, the main rope and climber not being represented.
Figure 6:
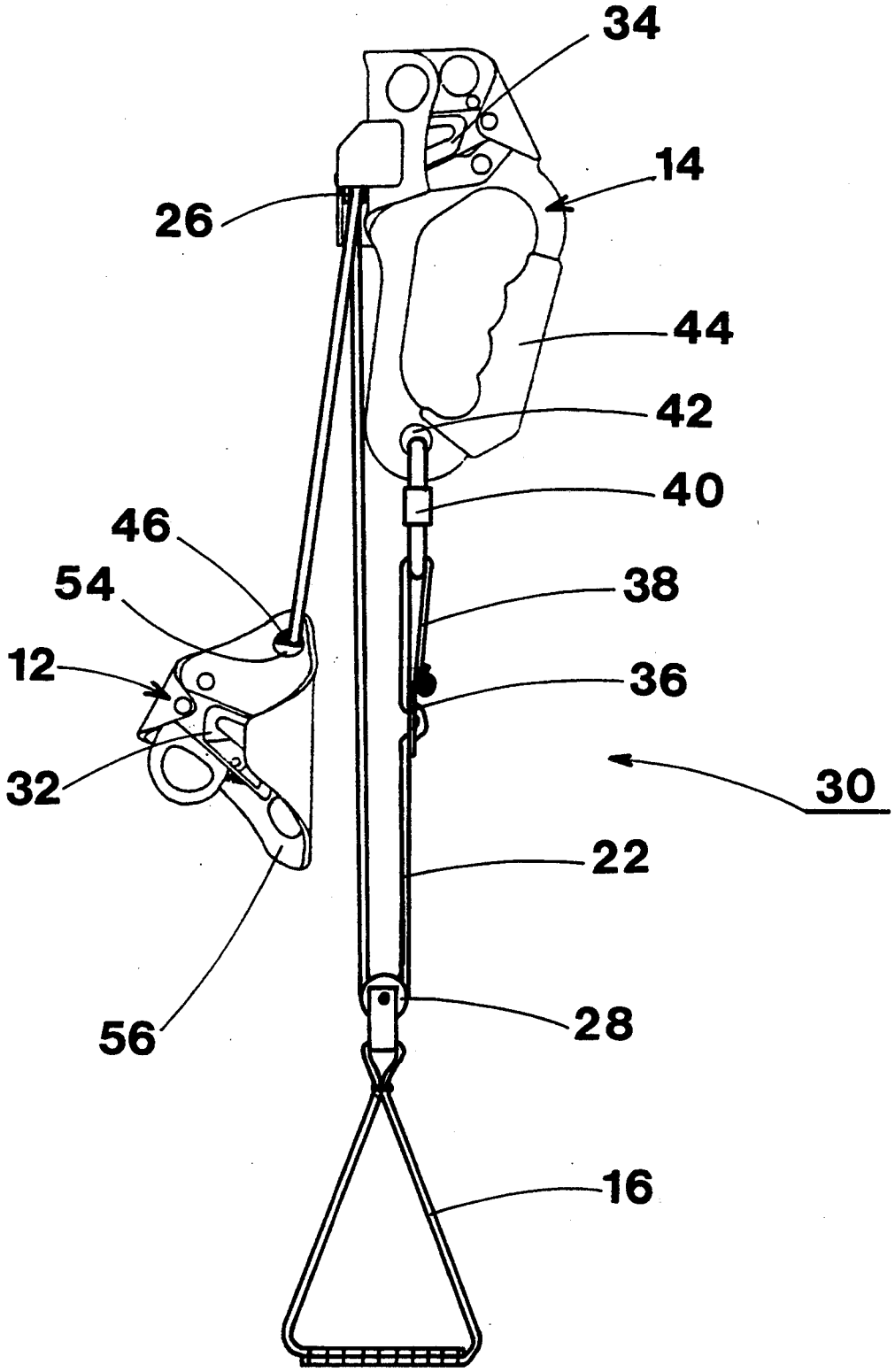
FIG. 6 shows in detail the ascending device according to FIG. 5, represented in the sitting position of the climber.
Figure 7:
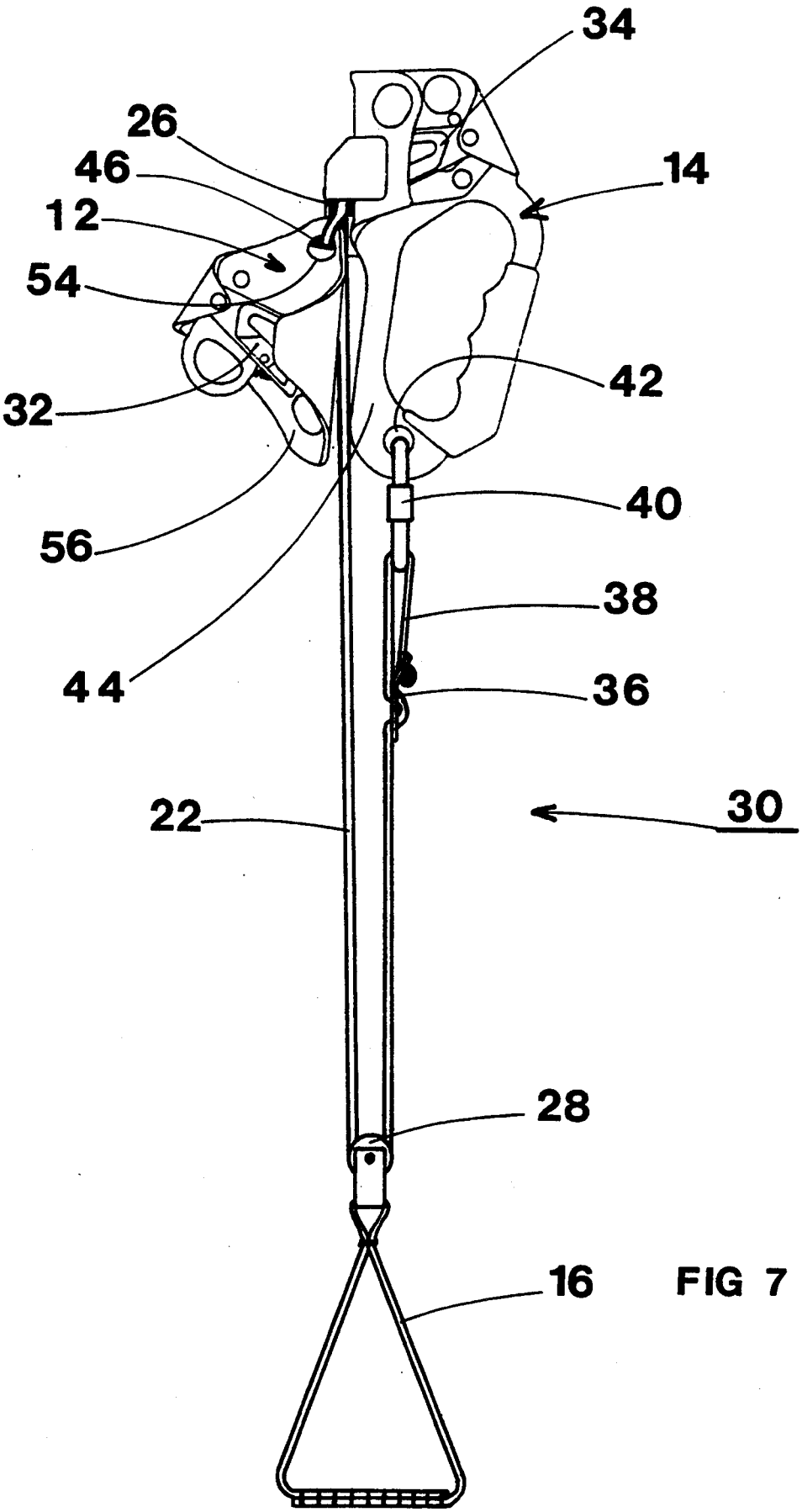
FIG. 7 is an identical view to FIG. 6, in the standing position of the climber.

Referring to FIGS. 5 to 7, the cord 22 of the leg loop 16 cooperates with a pair of pulleys 26,28 to form a tackle device 30. As for the "Italian" method in FIG. 4, one 46 of the ends of the cord 22 is secured to the first ascender 12, followed by engagement on the first upper pulley 26 associated with the second ascender 14.

But instead of fixing the other end directly to the leg loop 16, the cord 22 passes at the bottom part over a second pulley 28 secured to the leg loop 16, and is then secured by the opposite end to the second ascender 14.

The gearing down effect due to the presence of the tackle device 30 implies a moderate effort applied to the leg loop 16 when ascending. The force modulus F3 (FIG. 5) required for an ascending step of the climber 20 corresponds appreciably to two thirds of the weight P of the climber 20. The corresponding travel of the leg is about 1.5 times the distance of an ascending step.

The table below sums up the theoretical differences between the three above-mentioned methods, for the same ascending step d of a climber having a weight P:

| Method | Force on the pedal | leg travel | ascending step of the climber |
|---|---|---|---|
| FROG | $F1 = P$ | d | d |
| Italian | $F2 = \frac{P}{2}$ | 2d | d |
| Invention | $F3 = \frac{2P}{3}$ | $\frac{3d}{2}$ | d |

To give an example of the method according to FIGS. 5 to 7, for an ascending step of 50 cm, and for a weight P of 90 daN, the force F3 exerted by the leg of the climber 20 on the leg loop 16 is 60 daN, whereas the leg travel is about 75 cm.

The choice of such a gearing down effect for a reasonable leg travel is favorable to optimum operation of the sit-stand ascending system.

In FIGS. 6 and 7, the sit-stand ascending system shows the two different types of ascenders 12 and 14, the first 12 of which is a chest-mounting ascender secured to the harness 18, and the second 14 of which is associated with an ascension handle. Each of these ascenders 12,14 comprises, in state-of-the-art manner, a jamming catch 32,34 cooperating with the main rope 10.

To take account of the morphology of the climber 20, the tackle device 30 is equipped with a tightening adjuster 36 to adjust the useful length of the cord 22. One of the ends of the cord 22 forms an attachment ring 38 linked by means of a karabiner 40 in an orifice 42 at the bottom part of the gripping handle 44 of the second ascender 14.

Figure 8:
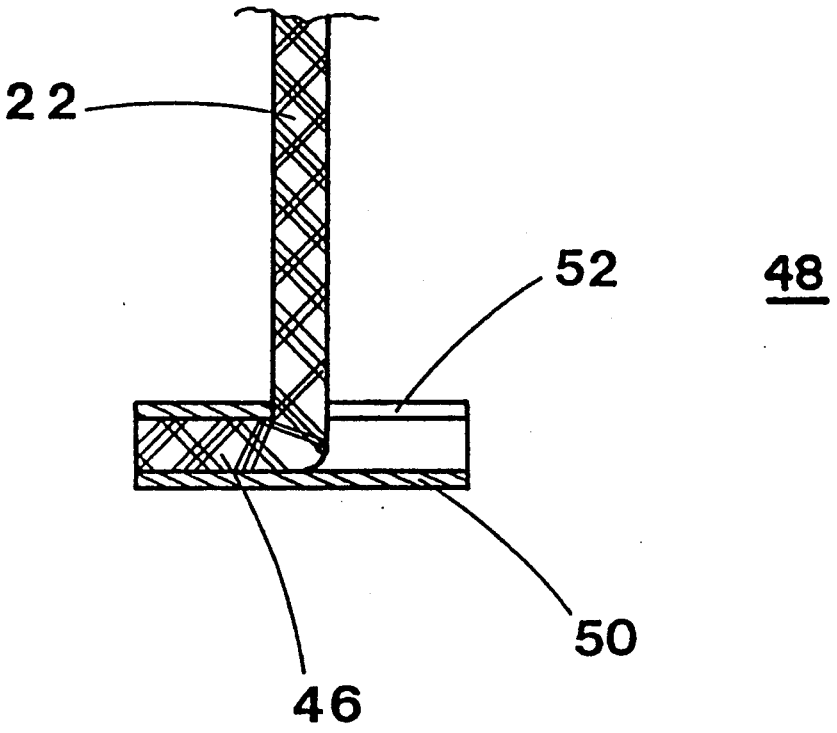
FIG. 8 illustrates a detail of embodiment of the end of the cord for attachment to the first ascender.
Figure 9:
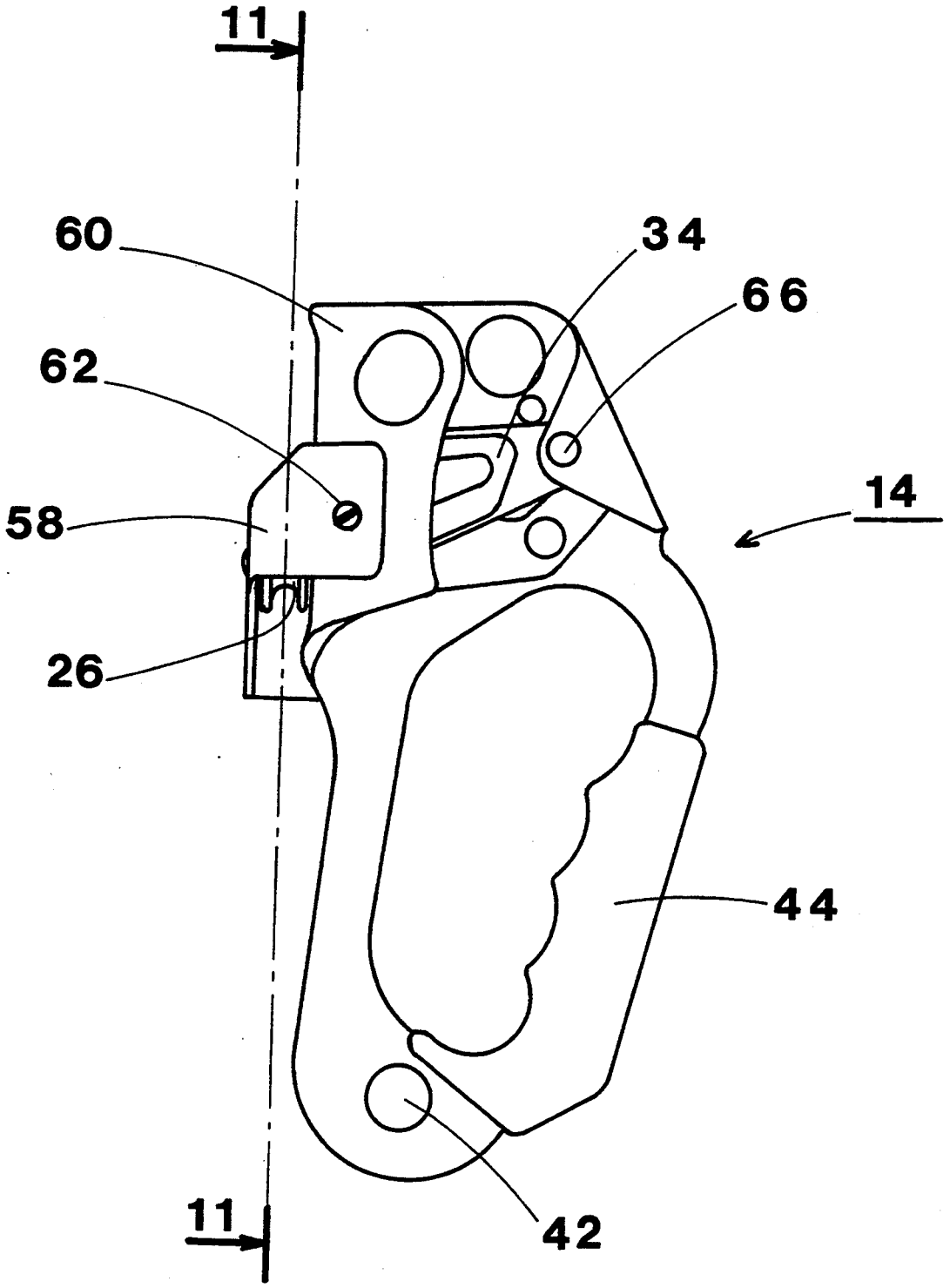
FIG. 9 is an elevational view of the second ascender.
Figure 10:
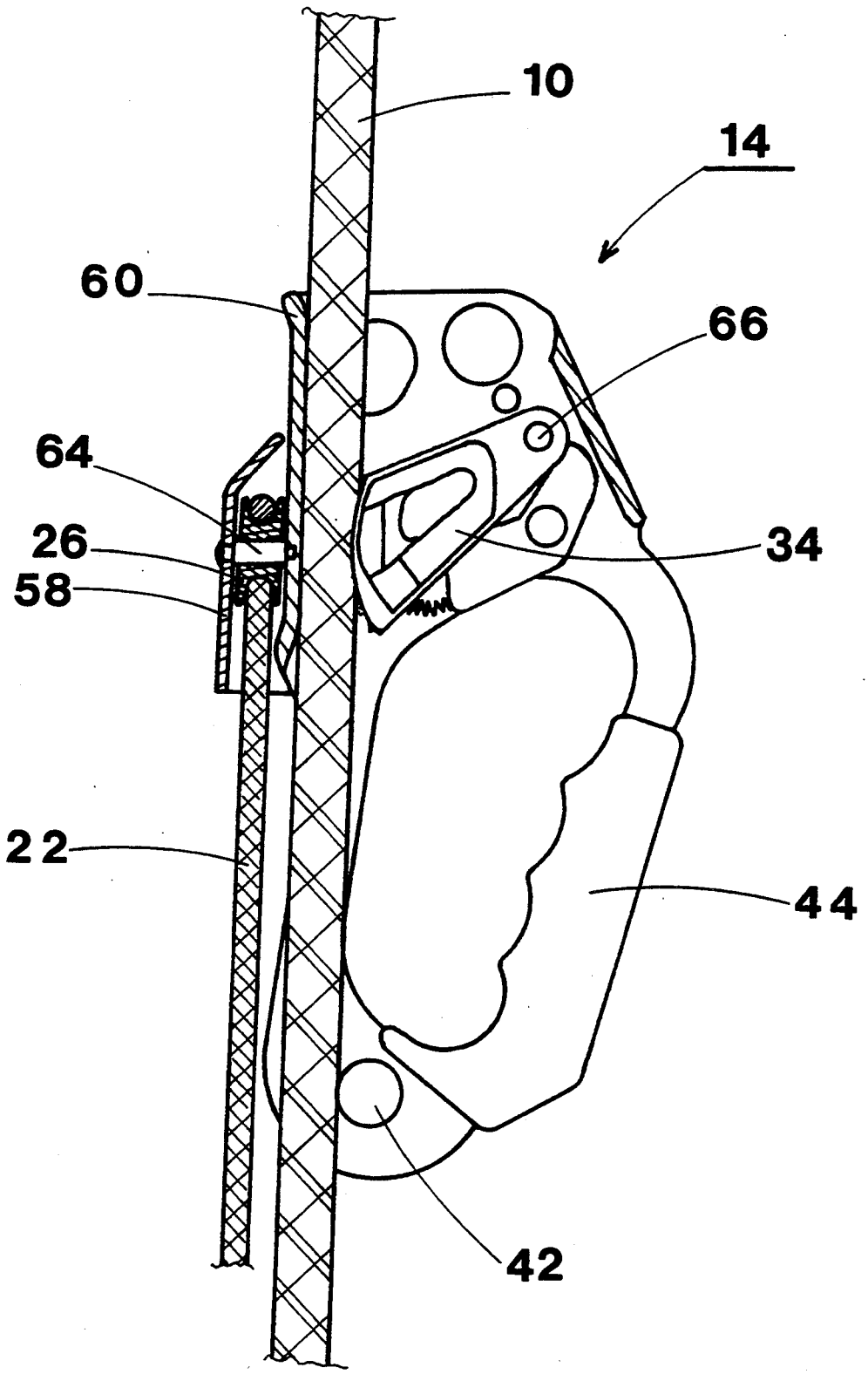
FIG. 10 shows a vertical sectional view of FIG. 9.
Figure 12:
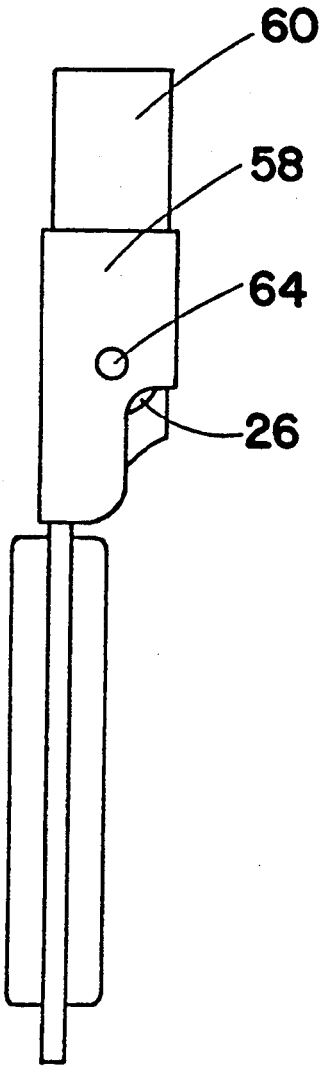
FIG. 12 is a side view of FIG. 9.
Figure 11:
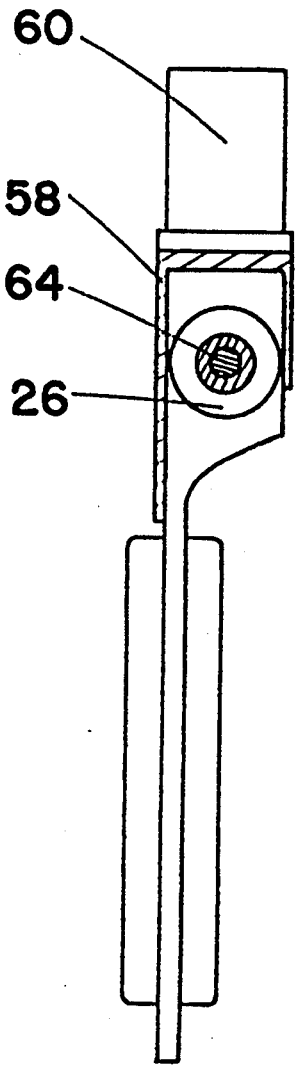
FIG. 11 is a cross section along the line 11—11 of FIG. 9.

The cord 22 at the outlet from the tightening adjuster 36 passes via the second pulley 28 of the leg loop 16. Opposite from the karabiner 40, the other end 46 of the cord 22, after passing over the first pulley 26, is fixed directly to the first ascender 12 by means of a knot, or a securing device 48, represented in FIG. 8.

The securing device 48 comprises for example a tube section 50 having a slot 52 for insertion of the end 46 of the cord 22. Fixing of the end 46 of the cord 22 inside the tube 50 is achieved by a crimping operation. It then suffices to introduce the tube 50 axially into a hole 54 of the flange 56 of the first ascender 12, and to point the tube 50 at right angles to ensure self-jamming of the securing device 48, and the attachment of the cord 22 to the first ascender 12. This attachment can then easily be undone, even in the presence of mud, or when wearing gloves.

In FIGS. 9 to 12, the pulley 26 of the second ascender 14 is housed laterally in a flange 58 secured to the external flank of the metal body 60 by fixing means 62. The axis 64 of the pulley 26 extends orthogonally with respect to the pivoting axis 66 of the catch 34, and is secured by one of its ends to the flange 58, and by its opposite end to the external flank of the body 60. The pulley 26 is mounted with free rotation on the axis 64, and is located appreciably at the level of the jamming zone defined by the catch 34.

Such a positioning of the pulley 26 above the lower orifice 42 of the second ascender 14, and the direct fixing of the cord 22 to the first ascender 12 enable an optimum step to be obtained when the climber is ascending during the first stage when he pushes on the leg loop 16. The travel of the first ascender 12 is then maximum (FIG. 7), which prevents too great a lifting of the second ascender 14 during the second stage.

Figure 14:
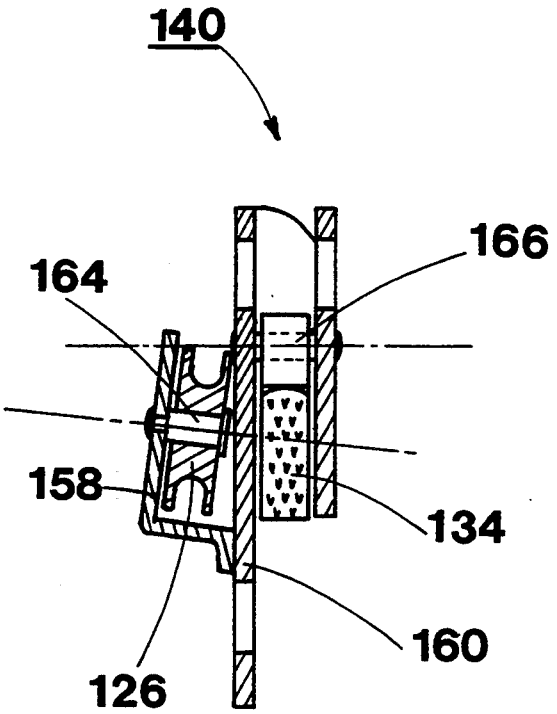
FIG. 14 shows a transverse sectional view along the line 14—14 of FIG. 13.
Figure 13:
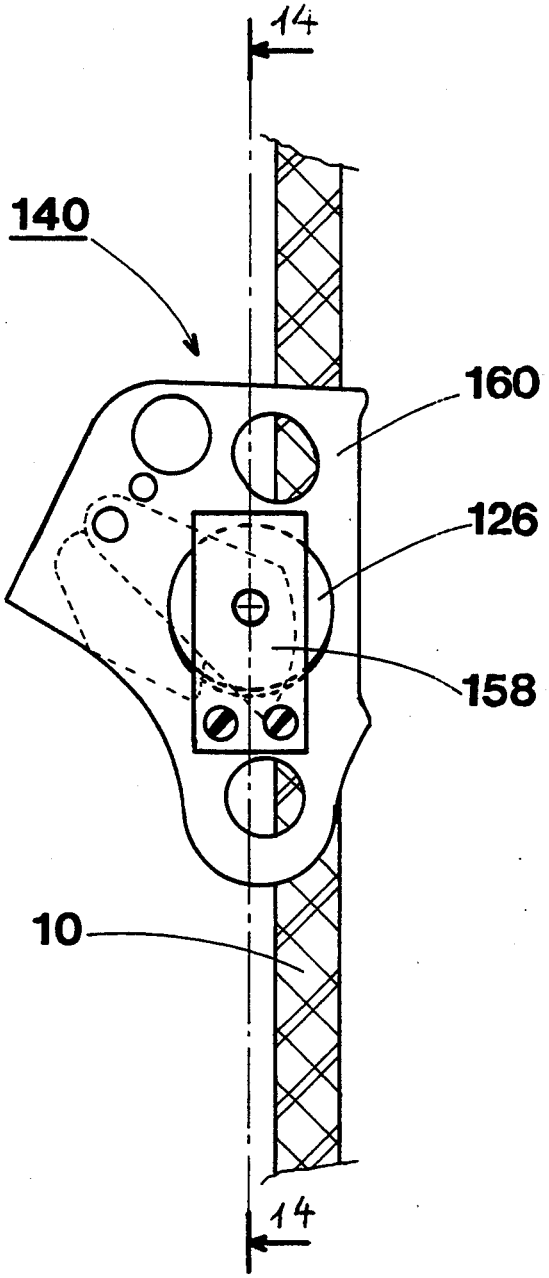
FIG. 13 is an alternative embodiment of FIG. 9.

FIGS. 13 and 14 represent an alternative embodiment of the second ascender 140, without the gripping handle. The flange 158 housing the pulley 126 is fixed to the rear of the body 160, and the axis 164 is slightly inclined with respect to the direction of the pivoting axis 166 of the catch 134. The angle of incline of the axis 164 is chosen to ensure correct positioning of the pulley 126 by the reaction of the cord 22 during the pushing phase on the leg loop 16.

I claim:

1. A device for ascending a climber along a main rope, comprising a dynamic sit-stand system including:

a roping harness borne by the climber in the ventral zone;

a first ascender fixed to the roping harness with passage of the main rope through the first ascender;

a second ascender engaged on the same main rope above the first ascender, and being movable in the ascending direction by the hand of the climber;

a first pulley fixed to said second ascender;

a leg loop in the form of a pedal cooperating with a link cord having a first end attached to the first ascender after passing over said first pulley and a second end secured to the second ascender; and a second pulley secured to the leg loop around which said link cord passes to form a tackle device for obtaining a gearing down effect which reduces the effort exerted by the leg of the climber on the leg loop, said second ascender having an external flank and a jamming catch, and said first pulley being positioned on said external flank at the level of the jamming catch.

2. The device of claim 1, wherein the first end of the link cord is attached to the first ascender by securing means inserted into said first ascender.

3. The device of claim 2, including a tightening adjuster means located on the link cord between the second ascender and the second pulley to adjust the useful length of the link cord.

4. The device of claim 1, including a tightening adjuster means located on the link cord between the second ascender and the second pulley to adjust the useful length of the link cord.

* * * * *